US007377096B2

(12) United States Patent
Wassenhoven

(10) Patent No.: US 7,377,096 B2
(45) Date of Patent: May 27, 2008

(54) OPEN-END ROTOR SPINNING DEVICE

(75) Inventor: Heinz-Georg Wassenhoven, Mönchengladbach (DE)

(73) Assignee: Oerlikon Textile GmbH & Co. KG, Monchengladbach (DE)

( * ) Notice: Subject to any disclaimer, the term of this patent is extended or adjusted under 35 U.S.C. 154(b) by 0 days.

(21) Appl. No.: 10/593,520

(22) PCT Filed: Mar. 10, 2005

(86) PCT No.: PCT/EP2005/002528

§ 371 (c)(1),
(2), (4) Date: Sep. 20, 2006

(87) PCT Pub. No.: WO2005/100652

PCT Pub. Date: Oct. 27, 2005

(65) Prior Publication Data

US 2007/0169460 A1 Jul. 26, 2007

(30) Foreign Application Priority Data

Apr. 10, 2004 (DE) ..... 10 2004 017 700

(51) Int. Cl.
*D01H 4/08* (2006.01)

(52) U.S. Cl. ..... 57/413

(58) Field of Classification Search ..... 57/404, 57/408, 413

See application file for complete search history.

(56) References Cited

U.S. PATENT DOCUMENTS

| | | | | |
|---|---|---|---|---|
| 5,111,651 A * | 5/1992 | Pohn et al. | ..... | 57/413 |
| 5,471,829 A | 12/1995 | Billner | ..... | 57/413 |
| 5,581,991 A * | 12/1996 | Billner | ..... | 57/413 |
| 5,595,058 A | 1/1997 | Billner | ..... | 57/413 |
| 5,749,216 A | 5/1998 | Lang et al. | ..... | 57/413 |
| 5,778,654 A | 7/1998 | Stahlecker | ..... | 57/413 |
| 5,901,546 A * | 5/1999 | Lovas et al. | ..... | 57/413 |
| 6,047,538 A | 4/2000 | Wassenhoven | ..... | 57/413 |
| 6,124,658 A | 9/2000 | Coenen | ..... | 310/90.5 |
| 6,289,663 B1 | 9/2001 | Schroder | ..... | 57/406 |

FOREIGN PATENT DOCUMENTS

| | | |
|---|---|---|
| DE | 195 44 617 A1 | 6/1997 |
| DE | 198 00 402 A1 | 9/1998 |

(Continued)

*Primary Examiner*—Shaun R. Hurley
(74) *Attorney, Agent, or Firm*—Kennedy Covington Lobdell & Hickman, LLP

(57) ABSTRACT

An open-end rotor spinning device comprising a spinning motor rotatable at high speed inside a rotor housing subjected to low pressure and closable by a covering element. A single motor-driven opening cylinder rotates in a opening cylinder housing. A fiber guiding channel (18) includes an output-side channel section extending in a channel plate adapter whose installation position in the covering element is specified by its position with regard to the spinning rotor, and an input-side channel section positioned inside the opening roller housing such that the center longitudinal axes of the channel sections are angled relative to one another. The operable spinning disposition of the input-side channel section (30) is selectively adjustable with regard to the output-side channel section (31) of the fiber guiding channel (18) to relatively displace their respective center longitudinal lines (32, 33) by angles (α, β) to obtain optimal yarn-dynamic values.

9 Claims, 4 Drawing Sheets

FOREIGN PATENT DOCUMENTS

| | | |
|---|---|---|
| DE | 198 36 066 A1 | 2/2000 |
| DE | 198 59 164 A1 | 6/2000 |
| DE | 102 10 895 A1 | 9/2003 |
| DE | 103 40 657 A1 | 3/2005 |
| EP | 0 972 868 A2 | 1/2000 |

* cited by examiner

OPEN-END ROTOR SPINNING DEVICE

CROSS-REFERENCES TO RELATED APPLICATIONS

This application claims the benefit of German patent application 102004017700.7, filed Apr. 10, 2004, herein incorporated by reference.

BACKGROUND OF THE INVENTION

The invention relates to an open-end rotor spinning device and, more particularly, to such a device comprising a spinning rotor rotating at high speed in a rotor housing subjected to low pressure and closed by a covering element, a single motor-driven opening cylinder rotating in an opening cylinder housing, and an at least two-part fiber guiding channel.

As described in numerous patent documents, for example German Patent Publications DE 198 00 402 A1 or DE 198 59 164 A1, open-end rotor spinning devices have a spinning rotor, which rotates during the spinning process at a high speed in a rotor housing subjected to low pressure. The rotor housing, which is open per se toward the front, is thus sealed in an air-tight manner during the spinning process by a covering element, into which a replaceable channel plate adapter is let. The covering element generally also has bearing brackets for an opening cylinder and for a fiber band feed cylinder. The covering element is connected so as to be movable to a limited extent to an associated spinning box housing via a pivot pin, which is arranged orthogonally to the axes of rotation of the opening cylinder and fiber band feed cylinder, the spinning box housing, for example, having the bearing and the drive for the spinning rotor. The individual fibers combed out from a feed fiber band, e.g., a sliver, by the opening cylinder are conveyed in such open-end rotor spinning devices via a so-called fiber guiding channel to the rotating spinning rotor and spun by the latter to form a thread which can be continuously drawn off.

The open-end rotor spinning devices described in the above patent documents have two-part fiber guiding channels. In other words, an input-side channel section is arranged in a receiver of an opening cylinder housing, while an output-side channel section is arranged inside the replaceable channel plate adapter, which is positioned in a corresponding receiver in the covering element. During operation, the channel plate adapter, which can be replaced when necessary and is fixed in a precise position in the receiver of the covering element and which, apart from the output-side channel section of the fiber guiding channel, also has a hole to fix a thread draw-off nozzle, reaches with a tower-like attachment into the rotating spinning rotor.

In conjunction with open-end rotor spinning devices, it has furthermore been known for a long time that in order to be able to produce open end yarns of good quality, certain boundary conditions, in particular with respect to the mutual arrangement and dimensioning of the spinning elements have to be fulfilled. The design and arrangement of the orifice region of the fiber guiding channel, in particular the spacing of the orifice to the fiber slide face in the spinning rotor, for example, have a not insignificant influence on the yarn quality which can be achieved. In the interests of optimal spinning results, it is therefore advantageous to allocate a suitable channel plate adapter to each spinning rotor, in particular according to its diameter. This means that in general a change of the channel adapter plate also takes place when an exchange of the spinning rotors is carried out, for example in the course of a yarn batch change.

It is also known that the fiber feed onto the fiber slide face of the spinning rotor can be positively influenced by a corresponding design of the fiber guiding channel. For example, the output-side channel section of the fiber guiding channel can be configured in such a way that its centre longitudinal line differs from a straight line.

In other words, the output-side channel section of the fiber guiding channel arranged in the channel plate adapter is either, as described in German Patent Publication DE 195 44 617 A1 curved or has, as stated in German Patent Publication DE 102 10 895 A1, an angled center longitudinal line. According to German Patent Publication DE 102 10 895 A1, an insertion piece is to be inserted into the output-side channel section of the fiber guiding channel, for example, in such a way that the centre longitudinal line of this channel section is angled. It has been found that owing to the curvature or the angled configuration of the output-side channel section, the fiber transport on this channel section and the feeding of the fibers onto the fiber slide face of the spinning rotor can be improved.

From German Patent Publication DE 198 36 066 A1, it is also known to arrange an input-side channel section of a fiber guiding channel connected to an opening cylinder housing and an output-side channel section of the fiber guiding channel arranged in a channel plate adapter in such a way that the centre longitudinal lines of these channel sections are arranged inclined at an angle. Such an arrangement of the channel sections of a fiber guiding channel has also proven advantageous for the producible yarn quality, in particular when the angle between the centre longitudinal lines of the channel sections is matched precisely to the existing yarn and/or spinning parameters.

SUMMARY OF THE INVENTION

Proceeding from the above-mentioned prior art, the invention is based on the object of providing a fiber guiding channel of the type described above, which, in a simple manner, allows optimization of the fiber feed onto the fiber slide face of a spinning rotor, in particular taking into account the respectively existing yarn and/or spinning parameters.

This object is achieved according to the invention by a open-end rotor spinning device comprising a spinning rotor, rotating during the spinning process at a high speed in a rotor housing subjected to low pressure and which can be closed by a covering element and a single motor-driven opening cylinder, which rotates in an opening cylinder housing, and an at least two-part fiber guiding channel. The output-side channel section of the fiber guiding channel extends in a channel plate adapter, the center longitudinal axis of which extends coaxially to the axis of rotation of the spinning rotor. The input-side channel section of the fiber guiding channel is positioned in the opening cylinder housing in such a way that the center longitudinal axes of the channel sections are arranged inclined with respect to one another. In accordance with the present invention, the input-side channel section of the fiber guiding channel is mounted so as to be movable to a limited extent with respect to the output-side channel section of the fiber guiding channel, and the center longitudinal line of the input-side channel section is displaceably arranged with respect to the center longitudinal line of the output-side channel section by angles to achieve optimal yarn-dynamic values.

Advantageous additional configurations and features of the present invention are described more fully hereinafter with respect to a preferred embodiment of the invention.

The embodiment of a fiber guiding channel according to the invention above-described has the advantage, in particular, that even after an exchange of the spinning means, for example as a result of a change in the yarn batch, optimal flow conditions can easily be ensured in the region of the fiber guiding channels and therefore an optimal fiber feed onto the fiber slide faces of the spinning rotors can be ensured. In other words, after an exchange of the channel plate adapter, which has become necessary owing to the change of the spinning rotor, it can be achieved, quickly and without problems, owing to a corresponding adaptation of the installation position of the input-side channel section of the fiber guiding channel that, between the centre longitudinal lines of the channel sections of the fiber guiding channel, optimal angles of inclination are adjusted. These optimal angles of inclination ensure that a uniform feed of the individual fibers onto the fiber slide face of the spinning rotor takes place. The input-side channel section, preferably fixed in a receiver of the opening cylinder housing, of the fiber guiding channel can be pivoted with the opening cylinder housing and be positioned without any problems such that all the desired angles of inclination can be implemented easily within certain adjustment ranges. This means that owing to the configuration of the fiber guiding channel according to the invention, which easily allows at any time, a defined positioning of the input-side channel section and therefore an optimal adjustment of the angles of inclination which can be adjusted between the centre longitudinal lines of the two channel sections, the stocking of a large number of input-side channel sections matched in each case especially to a specific channel plate adapter or its output channel section is superfluous. The possibility of defined adjustment of the angles of inclination between the channel sections of a fiber guiding channel also offers at all times, the chance of intervening in a targeted manner in the course of the flow of the transporting air stream acting inside the fiber guiding channel and improving the yarn-dynamic values of the yarn to be produced by optimization of the flow conditions.

Advantageously, the optimum adjustments of the angles of inclination here are already determined empirically beforehand, and for example filed in an electronic memory or in corresponding tables.

In a particularly advantageous embodiment, the opening cylinder housing with an input-side channel section of the fiber guiding channel positioned in a receiver of the opening cylinder housing, is mounted so as to be rotatable to a limited extent about a pivot point, which is located in the contact region of the two channel sections of the fiber guiding channel. The opening cylinder housing can be adjusted in this case both in first planes extending parallel to the axis of rotation of the spinning rotor and also in second planes extending parallel to the front side of the opening cylinder housing and can be fixed in each case in defined installation positions. In other words, an embodiment of this type allows a stepless adjustment of the angle position of the centre longitudinal line of the input-side channel section of the fiber guiding channel and therefore an exact adjustment of predetermined angles of inclination to the centre longitudinal line of the output-side channel section of the fiber guiding channel. The position of the centre longitudinal line of the output-side channel section arranged in the channel plate adapter preferably remains unchanged in this case. In other words, at least the position of the centre longitudinal axis of the channel plate adapter coaxially to the axis of rotation of the spinning rotor is predetermined by the installation position of the spinning rotor. As already indicated above, owing to the defined adjustment of the angles of inclination between the centre longitudinal lines of the output-side and the input-side channel section of the fiber guiding channel, the course of the flow inside the fiber guiding channel can be influenced in a targeted manner and therefore the feeding of the individual fibers brought with the transporting air stream onto the fiber slide face of the spinning rotor can be optimized.

In an advantageous embodiment, it is provided that the input-side channel section of the fiber guiding channel is configured in its orifice region as a ball joint, which, in the installed state corresponds with the input region, configured as a spherical cap, of the output-side channel section arranged in the channel plate adapter. The ball joint, in conjunction with the spherical cap, forms the pivot point for the input-side channel section of the fiber guiding channel or for the displaceably mounted opening cylinder housing. A ball joint configuration of this type of the contact region of the two channel sections ensures a maximum angle mobility of the two components of the fiber guiding channel with respect to one another and allows a stepless adjustment of the adjustably mounted input-side channel section with respect to the output-side channel section preferably arranged in a rigid installation position.

The center longitudinal line of the input-side channel section can be steplessly adjusted with respect to the centre longitudinal line of the output-side channel section of the fiber guiding channel in numerous planes. In other words, within predetermined adjustment ranges, any desired angle of inclination can be adjusted between the centre longitudinal lines of the two channel sections. In first planes, which extend parallel to the axis of rotation of the spinning rotor, an angle of inclination can be adjusted, for example, which may be between 0.1° and 10°. In second planes, which extend in each case parallel to the front side of the opening cylinder housing, the adjustable angle of inclination is between 1° and 20°.

Via the angles of inclination between the channel sections, as already indicated above, the course of the flow of the transporting air stream present in the fiber guiding channel can be influenced in a targeted manner and thus optimally adapted to the respectively existing conditions both with regard to the spinning means and also to the material to be spun.

It is also provided in an advantageous embodiment that the opening cylinder housing is pivotably connected to the covering element via a special bearing bracket. The bearing bracket is, for example, displaceably mounted on a pitch circle-shaped guide rail, and can be steplessly adjusted on this guide rail by a corresponding actuating drive and positioned precisely. In other words, with the bearing bracket, the opening cylinder housing and therefore the input-side channel section arranged in a receiver of the opening cylinder can be adjusted in a defined manner relative to the covering element in planes parallel to the front side of the opening cylinder housing. The input-side channel section is steplessly adjusted in this case around the pivot point described above, arranged in the contact region of the channel sections and formed by a ball joint connection.

Arranged on the bearing bracket is also a likewise pitch circle-shaped guide device, in which the opening cylinder housing is adjustably mounted with corresponding guide lugs. A corresponding actuating drive also allows a stepless adjustment here of the opening cylinder housing in the guide device. In other words, the opening cylinder housing is adjustable inside the guide device in planes, which extend in each case parallel to the axis of rotation of the spinning rotor. In this case, the pivoting of the input-side channel section also takes place steplessly about the above-mentioned ball joint connection in the contact region of the two channel sections of the fiber guiding channel.

BRIEF DESCRIPTION OF THE DRAWINGS

Further details of the invention can be inferred from a following embodiment shown with the aid of the drawings, in which.

DESCRIPTION OF THE PREFERRED EMBODIMENTS

Figure 1:
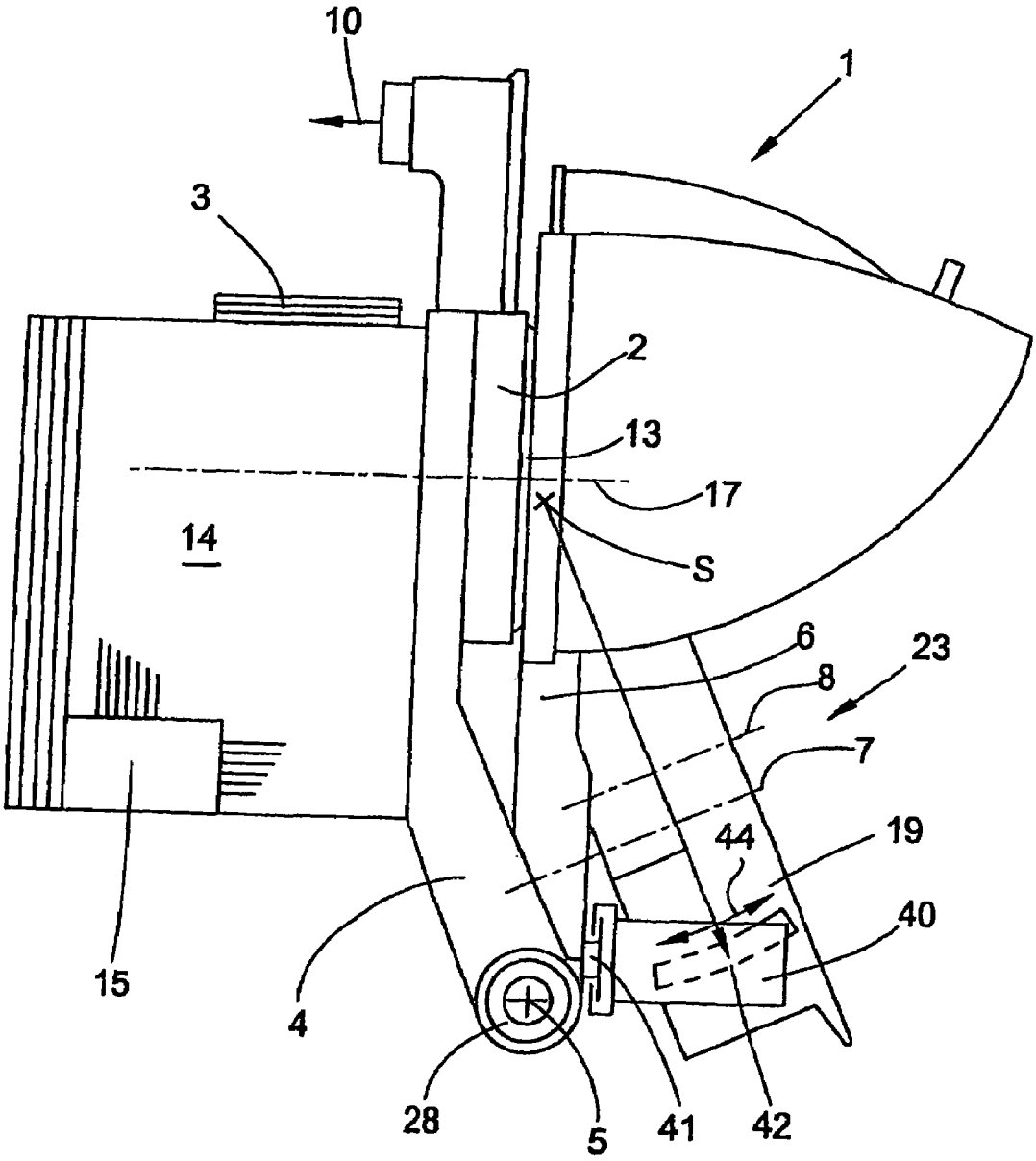
FIG. 1 shows an open end rotor spinning device, with a pivotably mounted opening cylinder housing, in a side view.
Figure 2:
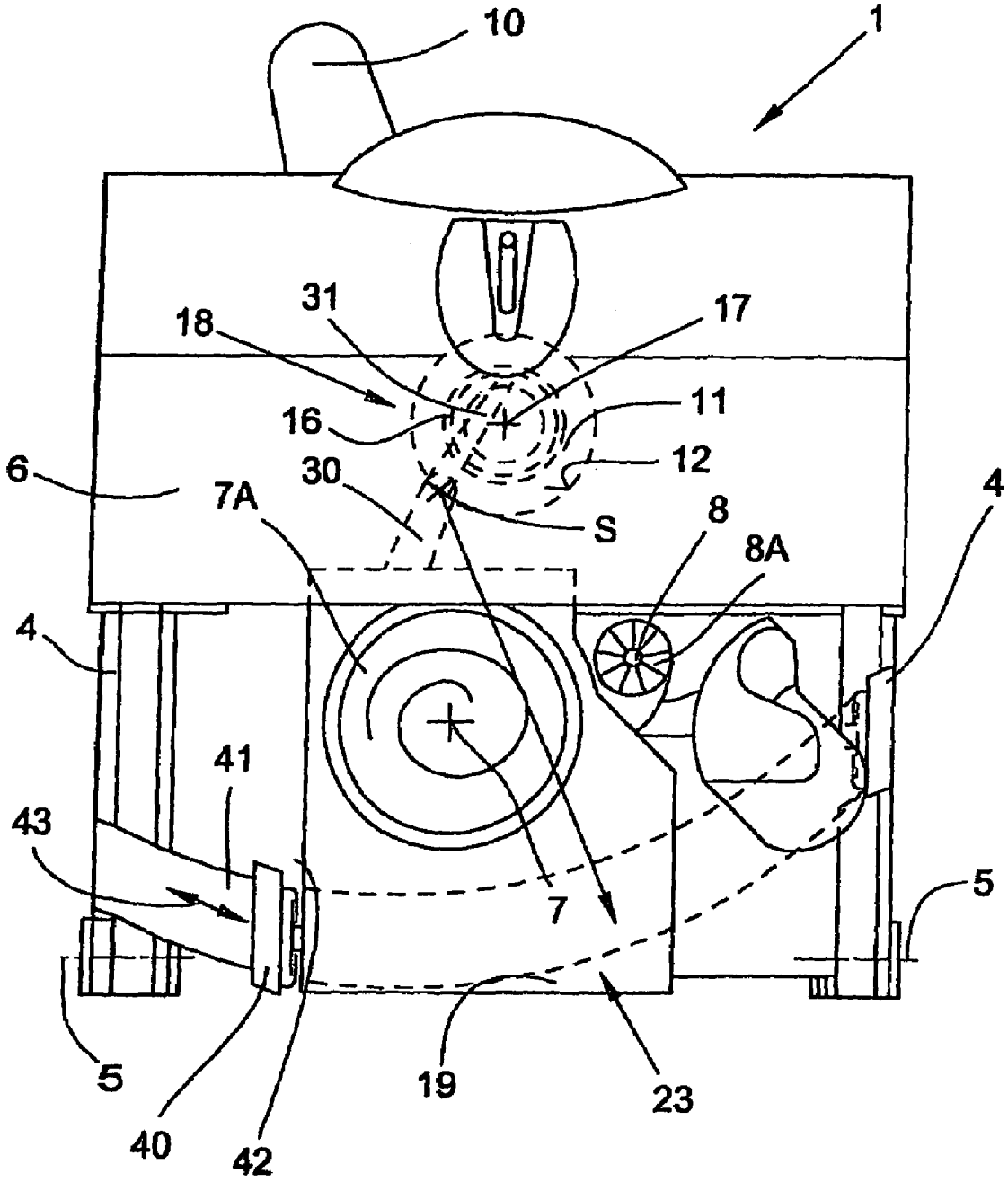
FIG. 2 shows the open-end rotor spinning device according to FIG. 1 in a front view.

Open-end rotor spinning devices which, as merely schematically indicated in FIGS. 1 and 2, are equipped with a single drive for the spinning rotor and, in each case, with single drives for the opening cylinder and the fibre band feed cylinder, are known in principle and described, for example, in the subsequently published German Patent Publication DE 103 40 657 A1.

Such open-end rotor spinning devices 1 have, for example, a spinning rotor 16 supported in magnet bearings (not shown), and electromagnetically driven by a single drive 3. The spinning cup of a spinning rotor 16 of this type merely indicated schematically in FIG. 1 by its axis of rotation 17, rotates during the spinning operation at a high speed in a rotor housing 2 which is subjected to low pressure. Spinning rotors mounted and driven in this manner are basically known and described in relative detail, for example, in European Patent Publication EP 0 972 868 A2.

In the embodiment shown, the rotor housing 2 of the open-end rotor spinning device 1, is preferably configured as a central, carrying component and consists of a metal with good heat conductivity, for example aluminum. The rotor housing 2 is, as conventional, connected via a pneumatic line 10 to a low pressure source (not shown). Apart from an individual drive for the spinning rotor 16, and an associated housing 14 for the control electronics 15, carriers 4 are also fixed via dowel pins and screw bolts to this rotor housing 2, which carriers are configured as bearing arms and have, in each case, on the ends, a bearing point equipped with a sliding bushing 28. A covering element 6 is pivotably mounted in these bearing points and closes the rotor housing 2 during spinning operation. In other words, the covering element 6 rests with an annular seal 13 on the front wall of the rotor housing 2 and closes this in an air-tight manner.

The pivot axis of the covering element 6 is characterized by the reference numeral 5.

Figure 3:
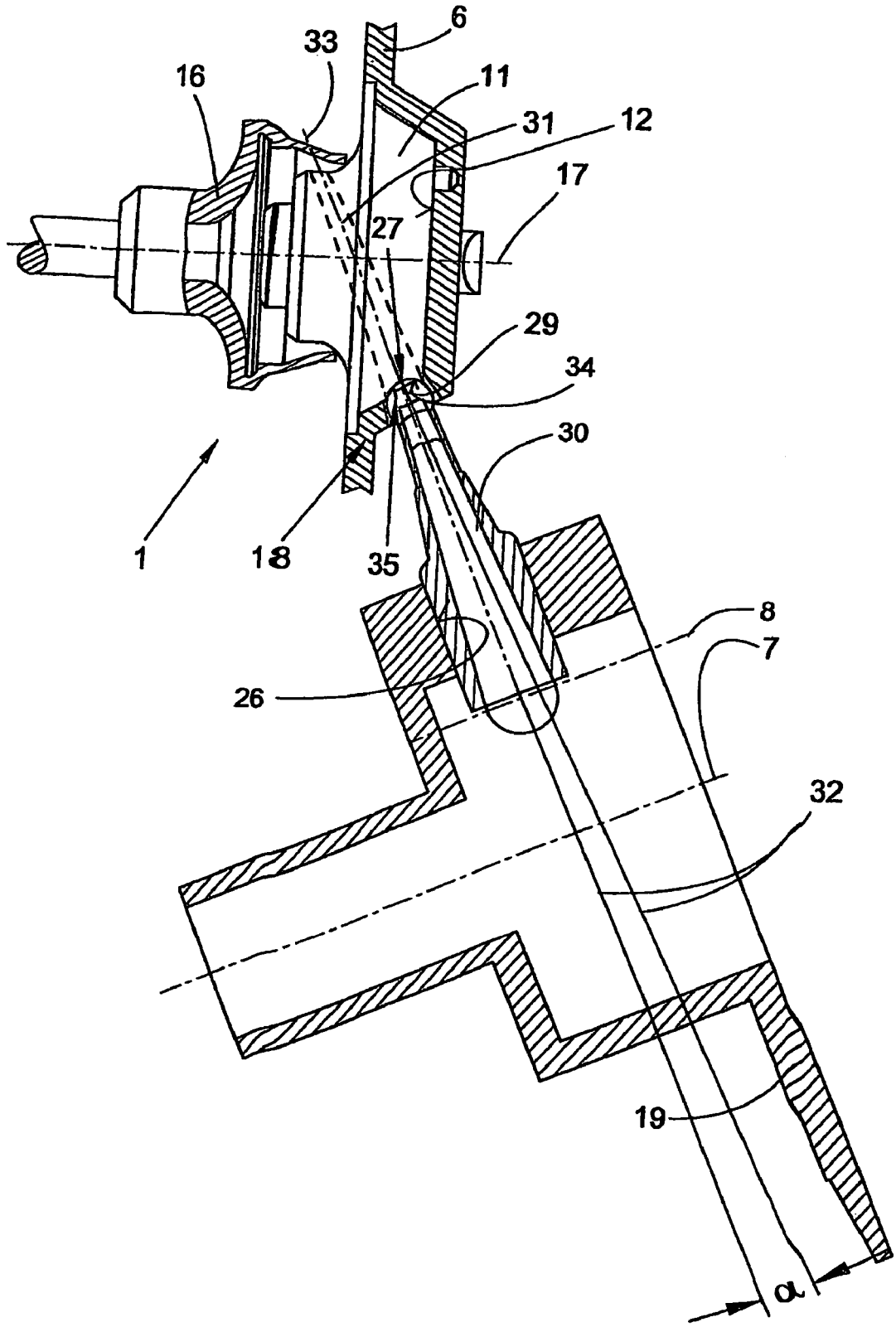
FIG. 3 shows a side view of the two-part fiber guiding channel of the open end rotor spinning device according to the invention, partially in section.

As can be seen, in particular from FIG. 3, the covering element 6 has a receiver 12 which is open in the direction of the spinning rotor 16, at the level of the axis of rotation 17 of the spinning rotor 16, into which receiver a channel plate adapter 11 can be fixed so as to be easily replaceable. In other words, the central longitudinal axis of the channel plate adapter 11 runs coaxially to the axis of rotation of the spinning rotor 16.

Figure 4:
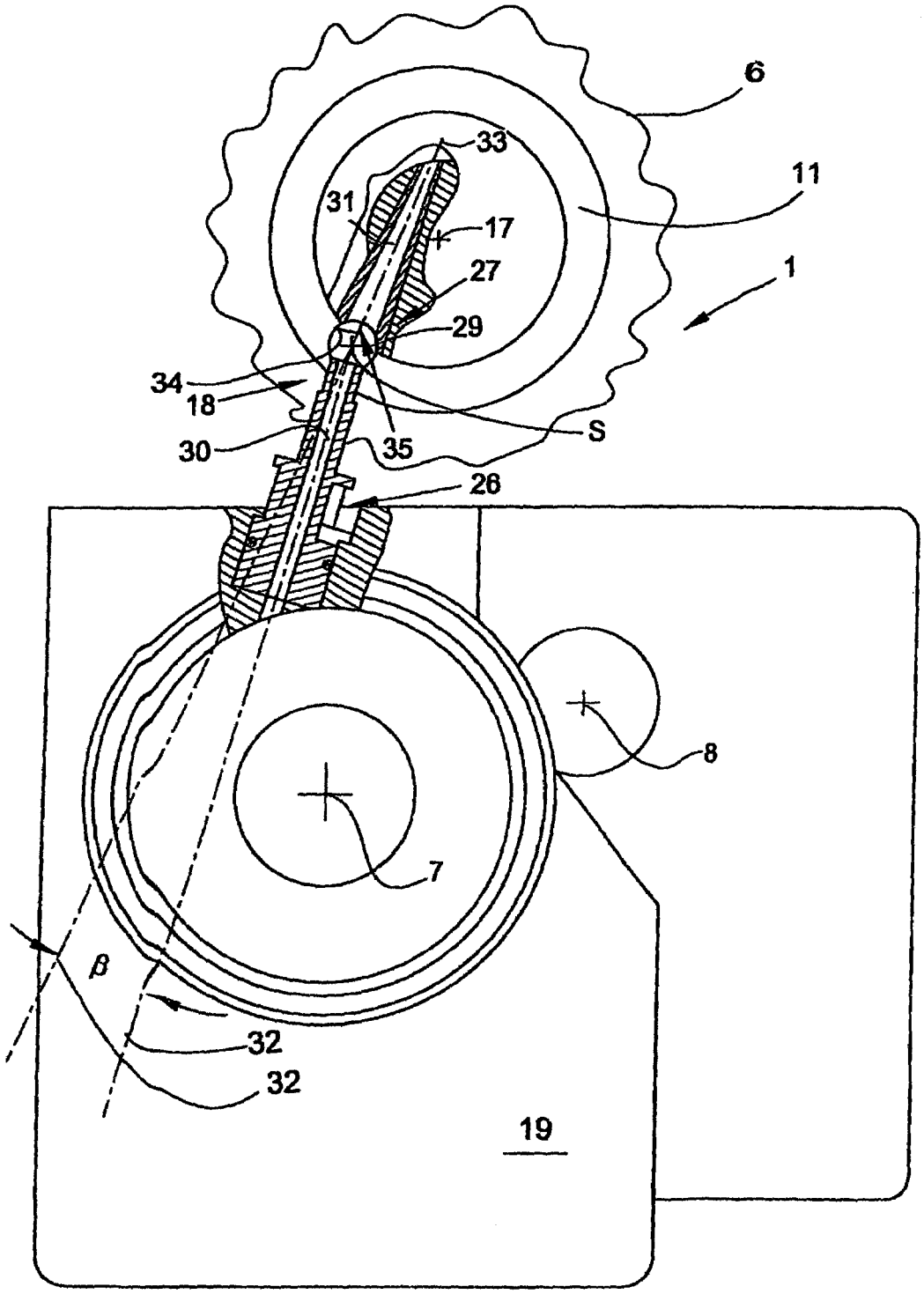
FIG. 4 shows a front view of the two-part fiber guiding channel according to the invention, according to FIG. 3, partially in section.

As further indicated in FIGS. 3 and 4, the output-side channel section 31 of a fiber guiding channel 18, is integrated, inter alia into the channel plate adapter 11 and connects the opening cylinder housing 19, pneumatically continuously, to the rotor housing 2. The input side channel section 30 of this fiber guiding channel 18 is arranged in a receiver 26 of the opening cylinder housing 19 fixed, as explained below, so as to be movable to a limited extent on the carrier element 6.

A fiber band opening mechanism 23 of the open-end rotor spinning device 1 is integrated, as usual, into the opening cylinder housing 19, which is mounted so as to be movable to a limited extent. In other words, a single motor-driven fiber band drawn-in cylinder 8A, the axis of rotation of which is designated 8, and a single motor-driven opening cylinder 7A, the axis of rotation of which bears the reference numeral 7.

As further indicated in FIG. 1, the opening cylinder housing 19 is connected via a guide device 42 to a bearing bracket 40 and can be pivoted by means of an actuating drive, which is indicated schematically by a double arrow 44, in planes, which are located in each case parallel to the axis of rotation 17 of the spinning rotor 16. The pivot point S in this case lies in the contact region of the channel sections 30, 31, of the fiber guiding channel 18. In other words, the central longitudinal line 32 of the input-side channel section 30 of the fiber guiding channel 18 arranged, as shown in FIGS. 3 and 4, in a receiver 26 of the opening cylinder housing 19, can be adjusted with respect to the centre longitudinal line 33 of the output-side channel section 31 by an angle a, which is preferably between 0.1° and 10°.

As the bearing bracket 40 is also in turn displaceably fixed on the covering element 6, as indicated in FIG. 2, via a guide rail 41, the opening cylinder housing 19 and therefore also the input-side channel section 30 of the fiber guiding channel 18 can also be adjusted by an angle $\beta$ in planes, which are located in each case parallel to the front side of the opening cylinder housing 19. The angle position of the respective plane of the front side of the opening cylinder 19 is produced in this case from the angle $\alpha$. The pivot point S is also located here in the contact region of the channel sections 30, 31 of the fiber guiding channel 18. The angle $\beta$ which can be adjusted between the centre longitudinal lines 32, 33 of the channel portions 30, 31 of the fiber guiding channel 18 is, in this case, between 1° and 20°.

The pivoting of the opening cylinder housing 19 preferably takes place via a corresponding actuating drive, which can be controlled in a defined manner, which is indicated schematically by a double arrow 43 in FIG. 2.

The pivot point S for the opening cylinder housing 19 and therefore for the input-side channel section 30 is located, as already indicated above, and in particular visible from FIGS. 3 and 4, in the contact region of the channel sections 30, 31 of the fiber guiding channel 18. The input-side channel section 30, in the region of its orifice 27, has a ball joint 29, which corresponds with a correspondingly configured spherical cap 34 in the region of the inlet opening 35 of the output-side channel section 31. In other words, the central longitudinal lines 32, 32 of the channel sections 30, 31, intersect in the region of the pivot point S.

As indicated in FIGS. 3 and 4, by corresponding pivoting of the opening cylinder housing 19, any angle of inclination $\alpha$, which is between 0.1° and 10°, and also any angle of inclination $\beta$, which can be between 1° and 20°, can be steplessly adjusted between the centre longitudinal lines 32, 33 of the channel sections 30, 31 of the fiber guiding channel 18 and therefore the fiber flow within the fiber guiding channel 18 can be optimised.

The invention claimed is:

1. Open-end rotor spinning device comprising a spinning rotor, which rotates during the spinning process at a high speed in a rotor housing, which can be subjected to low pressure and which can be closed by a covering element, comprising a single motor-driven opening cylinder, which rotates in an opening cylinder housing, and also comprising an at least two-part fiber guiding channel, wherein the output-side channel section of the fiber guiding channel extends in a channel plate adapter, the center longitudinal axis of which extends coaxially to the axis of rotation of the spinning rotor, and the input-side channel section of the fiber guiding channel is positioned in the opening cylinder housing in such a way that the center longitudinal axes of the channel sections are arranged inclined with respect to one another, characterized in that the input-side channel section (30) of the fiber guiding channel (18) is mounted so as to be selectively movable to a limited extent with respect to the output-side channel section (31) of the fiber guiding channel (18) for adjustable setting of an operating disposition of the input-side channel section (30) angularly relative to the output-side channel section (31) when the covering element is closed on the rotor housing for performing the spinning process, said adjustable setting of the operating disposition of the input-side channel section (30) causing the center longitudinal line (32) of the input-side channel section (30) to be selectively displaceably arranged with respect to the center longitudinal line (33) of the output-side channel section (31) by angles ($\alpha$, $\beta$) to achieve optimal yarn-dynamic values.

2. Open-end rotor spinning device according to claim 1, characterized in that the optimal values for the respective spinning rotor (16), of the angles ($\alpha$, $\beta$) which can be adjusted between the center longitudinal lines (32, 33) of the channel sections (30, 31), can be determined empirically.

3. Open-end rotor spinning device according to claim 1, characterized in that the opening cylinder housing (19) with the input-side channel section (30), positioned in a receiver (26) of the opening cylinder housing (19), of the fiber guiding channel (18), can be rotated to a limited extent about a pivot point (S) arranged in the contact region of the channel sections (30, 31), can be adjusted in first planes parallel to the axis of rotation (17) of the spinning rotor (16) and in second planes (B) parallel to the front side of the opening cylinder housing (19) and can be fixed in a predeterminable installation position.

4. Open-end rotor spinning device according to claim 1, characterized in that the input-side channel section (30) of the fiber guiding channel (18) is configured in its orifice region (27) as a ball joint (29), which in the installed state, corresponds with the input region (35), configured as a spherical cap (34), of the output-side channel section (31), arranged in the channel plate adapter (11), of the fiber guiding channel (18).

5. Open-end rotor spinning device according to claim 1, characterized in that the input-side channel section (30) of the fiber guiding channel (18) can be adjusted in planes, which are located parallel to the axis of rotation (17) of the spinning rotor (16) in such a way that the center longitudinal line (32) of the input-side channel section (30) adopts an angle (a) with respect to the center longitudinal line (33) of the output-side channel section (31) of the fiber guiding channel (18), which is between 0.1° and 10°.

6. Open-end rotor spinning device according to claim 1, characterized in that the input-side channel section (30) of the fiber guiding channel (18) can be adjusted in planes, which are located in each case parallel to the front side of the opening cylinder housing (19) in such a way that the center longitudinal line (32) of the input-side channel section (30) of the fiber guiding channel (18) adopts an angle (R) with respect to the longitudinal line (33) of the output-side channel section (31) of the guiding channel (18), which is between 1° and 20°.

7. Open-end rotor spinning device according to claim 1, characterized in that the opening cylinder housing (19) is connected to the covering element (6) via a displaceably mounted bearing bracket (40).

8. Open-end rotor spinning device according to claim 7, characterized in that the bearing bracket (40) is displaceably mounted on a pitch circle-shaped guide rail (41), can be loaded in a defined manner by an actuating drive (43) and can be locked in predeterminable positions.

9. Open-end rotor spinning device according to claim 7, characterized in that the bearing bracket (40) has a pitch circle-shaped guide device (42), on which the opening cylinder housing (19) is displaceably mounted and can be transferred into predeterminable positions by means of an actuating drive (44).

* * * * *